United States Patent [19]

Suzuki

[11] Patent Number: 4,893,698

[45] Date of Patent: Jan. 16, 1990

[54] EXHAUST BRAKE UNIT EQUIPPED WITH A PAIR OF SWING FLAP VALVES

[75] Inventor: Ryoichi Suzuki, Mishima, Japan

[73] Assignee: USUI Kokusai Sangyo Kaisha, Ltd., Shizuoka, Japan

[21] Appl. No.: 214,646

[22] Filed: Jul. 1, 1988

[30] Foreign Application Priority Data

Jul. 4, 1987 [JP] Japan ..... 62-166287

[51] Int. Cl.[4] ..... F02D 9/06; F22B 21/00

[52] U.S. Cl. ..... 188/273; 123/323; 137/601

[58] Field of Search ..... 188/273, 154; 137/601; 123/323; 60/292, 324

[56] References Cited

U.S. PATENT DOCUMENTS

| | | | |
|---|---|---|---|
| 1,577,466 | 3/1926 | Hyre | 188/273 |
| 3,331,394 | 7/1967 | Hefler et al. | 137/601 X |
| 4,369,623 | 1/1983 | Johnson | 417/349 X |
| 4,377,181 | 3/1983 | Chan | 137/601 X |
| 4,408,627 | 10/1983 | Harris | 188/273 X |
| 4,633,900 | 1/1987 | Suzuki | 137/601 X |
| 4,658,857 | 4/1987 | Ayres | 137/601 |

FOREIGN PATENT DOCUMENTS

| | | | |
|---|---|---|---|
| 59-30196 | 8/1984 | Japan . | |
| 0684260 | 9/1979 | U.S.S.R. | 137/601 |

*Primary Examiner*—Robert J. Oberleitner

*Attorney, Agent, or Firm*—Wenderoth, Lind & Ponack

[57] ABSTRACT

An exhaust brake unit comprises a case to be inserted into an exhaust gas line, a valve seat located inside the case so as to encircle an exhaust gas passage, a pair of cavities formed on opposite side walls along the exhaust gas passage, a pair of shafts mounted in the respective cavities, and a pair or swing flaps mounted on the respective shafts. Facing flaps open and close the exhaust gas passage through the action of being engaged with the valve seat and disengaged from it. The flaps are connected to an actuating means by way of a linking mechanism which can be variously modified. The flaps may have unequal areas and/or have a time lag between their opening movements to reduce the force and time required to open the flaps.

5 Claims, 5 Drawing Sheets

14
2
20
17B
7A
15
17A
16
18A
18B
8
6A
II
II
9A
9B
4
1
7A
12
5B
5A
3
2

EXHAUST BRAKE UNIT EQUIPPED WITH A PAIR OF SWING FLAP VALVES

BACKGROUND OF THE INVENTION

This invention relates to an exhaust brake unit which is generally inserted into exhaust pipe connections of automobiles so as to effect an auxiliary braking system by closing an exhaust gas passage.

Different types of exhaust brake units are already known. In a first type, a gate valve slides vertically to the direction of an exhaust gas flow. In a second type, a butterfly plate or a flap is provided with an exhaust gas passage, swinging to open and close the passage. In the latter type, there is a disadvantage in that the valve member and its hinge portion are liable to be damaged or destroyed because they are directly exposed to the heat of the exhaust gas. Another disadvantage is that while the valve member is held at an open position in a normal driving mode, it causes considerable flow resistance against the exhaust gas flow, which has a bad influence upon the driving speed.

In Japanese Utility Model Publication No. 301986/84 issued on Aug. 29, 1984, there is disclosed an exhaust brake unit in which a cavity is formed inside a case parallel to the direction of the exhaust gas flow, a hinge being located at an end of the cavity, a flap-type valve member being mounted on the hinge and swinging thereon, so that the valve member is adapted to open and close the exhaust gas passage. In this design, during the closing stroke the single flap should swing upon the hinge against the direction of the exhaust gas flow, overcoming the exhaust gas pressure so as to shut-off the exhaust passage. The hinge and a shaft for the flap are thus subjected to great stress, and as a are worn out within a relatively short period and have poor durability. Moreover, since a large force is needed to move the flap toward the closing direction, the dimensions of the actuating means such as a cylinder or a vacuum diaphragm become large and an accommodation space for the exhaust brake unit also becomes large. Thus, the production cost is increased.

Some types of the exhaust brake units have another problem in that a complete shut-off is not effected, giving a poor braking performance.

SUMMARY OF THE INVENTION

It is an object of the present invention to provide an exhaust brake unit which can reduce the flow resistance against the exhaust gas flow at an open position of the valve in a normal driving mode.

Another object of the present invention is to provide an exhaust brake unit in which the valve member can move smoothly and quickly during the moment of pressing and releasing the exhaust brake.

Still another object of the present invention is to provide an exhaust brake unit having a small size, light weight and a high braking performance.

The present invention is directed to the type of an exhaust brake unit having a case to be inserted into an exhaust gas line, in which case a valve seat is located so as to encircle an exhaust gas passage, and by working of actuating means a swing flat is engaged with the valve seat and disengaged from it thereby to open and close the exhaust gas passage.

According to the invention, in the exhaust brake unit of the kind set forth, a pair of cavities are formed on opposite side walls along the exhaust gas passage inside the case, a pair of hinges being formed in the respective cavities, and a pair of swing flaps are mounted on the respective hinges, whereby facing flaps open and close the the exhaust gas passage through the action of being engaged with the valve seat and disengaged from it.

This ensures that the flow resistance against the exhaust gas flow in a normal driving mode is considerably reduced and the flaps are protected from thermal distortion or destruction, because the hinges and the flaps are retracted from the exhaust gas passage and accommodated within the cavities formed in the side walls of the case during the open position of the valve. The arrangement of the pair of facing flaps ensures that the pressure force exerting upon the hinge and the valve shaft is divided into two directions, so that the durability of the flap, hinge and the brake unit is considerably improved. Further, since the working stroke of the valve member is shortened by this arrangement, the action of the valve member becomes smooth and quick. The working stroke of the actuating means for moving the valve member is also shortened and the brake unit can be made light and compact. Since the pair of flaps are engaged with the corresponding valve seat portions, sealing efficiency at the closed position of the flaps is improved and braking performance is intensified.

The pair of swing flaps may operate in synchronized fashion or in delayed fashion. In the latter fashion, at first one of the flaps leaves the corresponding valve seat portion and after a moment the other of the flaps leaves the corresponding one. When only one flap begins to leave the valve seat portion, only a small force is needed to open the valve. It has an advantage that a return stroke of the brake can be finished quickly.

In a preferable embodiment, the flaps are arranged such that they move toward the same direction as the exhaust gas flow during the closing stroke of the valve. In addition to this arrangement, if the pair of flaps operate in delayed fashion, at the moment when one of the flaps begins to leave the valve seat portion exhaust gas flows out therefrom and exhaust gas pressure acting upon the other flap instantly drops. Thus, the opening force of the other flap is also reduced. As a result, the sense of response or reaction at the moment of releasing the exhaust brake can be considerably improved. Further, if an area of the early opening flap is smaller than that of the delayed opening flap, the return stroke of the exhaust brake is finished more quickly. Accordingly, the operating performance of the exhaust brake is prominently improved, so that the application range of the exhaust brake is broadly extended.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
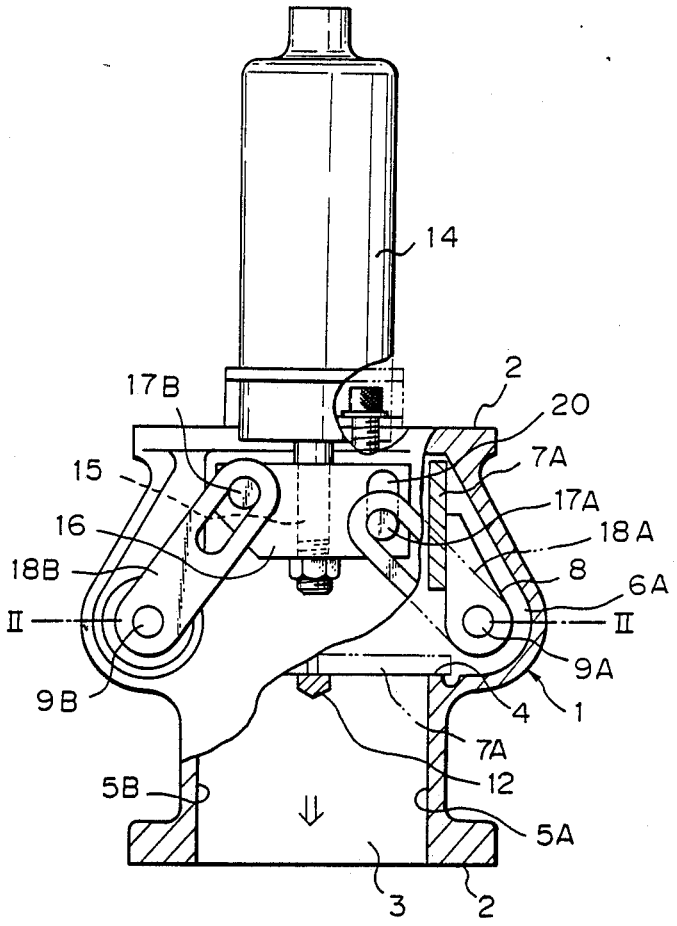
FIG. 1 is a side elevational view, partly in section, of a first embodiment of the exhaust brake unit according to the invention.
Figure 2:
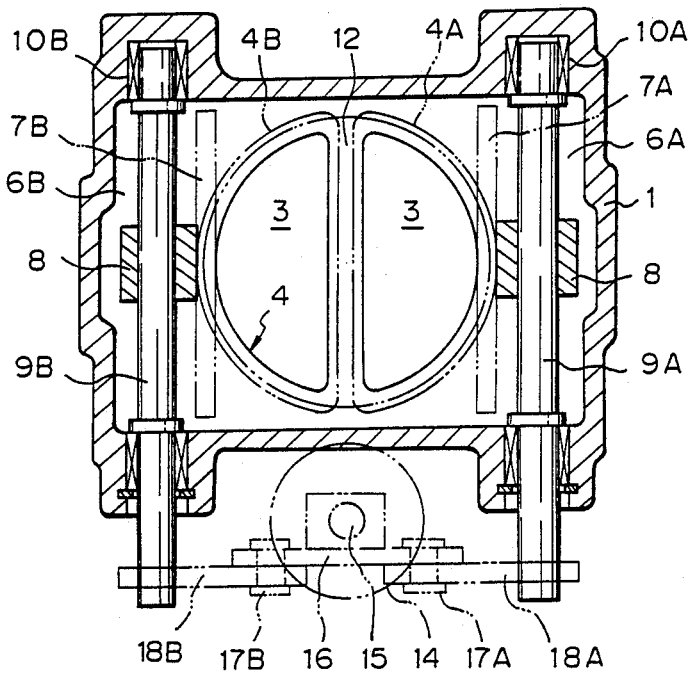
FIG. 2 is a horizontal sectional view taken along the line II—II of FIG. 1.

Referring to FIGS. 1 and 2, there is shown an exhaust brake unit of the first embodiment according to the invention. This brake unit is inserted into an exhaust gas line by connecting flanges 2 formed on the upper and lower ends of case 1 with associated exhaust pipes (not shown), respectively. Inside the case 1 a valve seat 4 is formed on the interior wall so as to encircle an exhaust gas passage 3 having a circular cross-section. Upon the opposite side walls 5A and 5B along the exhaust passage 3, a pair of cavities 6A and 6B are formed such that each cavity protrudes outwardly from the interior surface of the side walls. In these cavities, a pair of shafts 9A and 9B and a plurality of bearings 10A and 10B for supporting base ends 8 of semi-circular swing flaps 7A and 7B are disposed. While the valve is fully opened, oppositely located flaps 7A and 7B are accommodated within a retracted position such that the flaps are directed parallel to the exhaust passage 3. Accordingly, exhaust gas can flow almost unrestricted. When the valve is closed in turn, the flaps 7A and 7B rotate along the same direction as the exhaust gas flow and then each flap contacts with an associated valve seat portion 4A or 4B of the valve seat 4 to shut-off the exhaust passage 3.

At the center of the circular valve seat 4, a transverse rib 12 is formed traversing across the exhaust passage 3. When the valve is fully closed, the rib 12 can seal a gap produced between opposite edges of the flaps 7A and 7B. If a complete shut-off is not needed, such as it is desired to prevent an engine from stopping due to the working of the exhaust brake, the transverse rib 12 may be removed. The exhaust gas can escape from the gap between the adjacent edges.

Outside the case 1, a conventional actuator 14 such as an air cylinder or a vacuum diaphragm is located parallel to the axial direction o the case 1 which is the same direction as the exhaust gas flow. The flaps 7A and 7B are connected to the actuator 14 through the following linking mechanism. A guide plàte 16 is fixed near the lowermost end of a rod 15 of the actuator 14. Shafts 9A and 9B are supporting the flaps 7A and 7B, respectively. Between the guide plate 16 and the shafts 9A and 9B, pins 17A and 17B and swing levers 18A and 18B are situated. Thus, the flaps 7A and 7B are pivotally rotated by working of the actuator 14.

Figure 3:
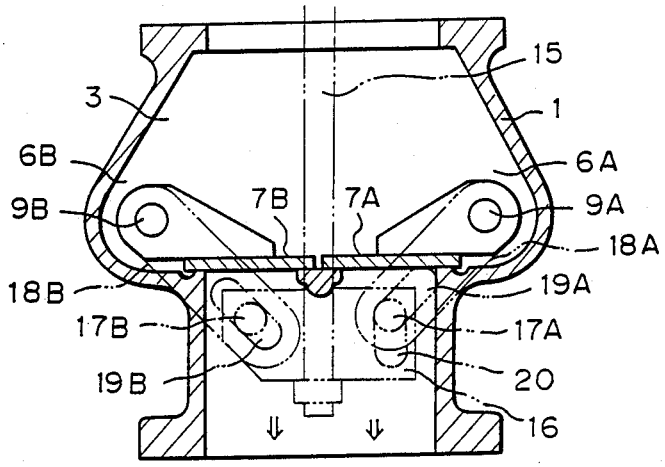
FIG. 3 is a vertical sectional view illustrating a linking mechanism of the first embodiment.

FIG. 3 is an explanatory drawing which shows the actions of the pins and levers of the aforementioned linking mechanism. At one side of the guide plate 16, a pin 17B extending vertically to the rod 15 is fixed. The pin 17B is received within a slot 19B formed at one end of the lever 18B and it slides along the interior surface of the slot 19B during the swinging movement of the lever 18B. The other end of the lever 18B is fixed on the outwardly projecting end of the shaft 9B. At the other side of the guide plate 16, a slot 20 extending along the axial direction of the case 1 is formed. Within the slot 20 a movable pin 17A is slidably received and on the other end it engages with a slot 19A formed at one end of a lever 18A. Thus, the pin 17A slides along the interior surface of the slot 91A during the swinging movement of the lever 18A and simultaneously slides along the interior surface of the slot 20.

The first embodiment shown in FIGS. 1 to 3 is operated as follows. When the actuator 14 is energized to open the valve, the rod 15 moves upward, that is the direction of releasing the brake, and makes the flaps move from the closed position as shown in straight lines of FIG. 3. At first only flap 7B is raised, then at the moment when the pin 17A abuts with the lowermost end of the slot 20 the flap 7A begins to open. Thus, a time lag is produced between the starting movements of the flaps 7A and 7B. Therefore, as explained before, only a small force is needed at the moment of opening the valve. Further, when the flap 7B begins to open, exhaust gas flows out and exhaust gas pressure acting upon the flap 7A drops. Thus, the force to open the flap 7A is also reduced, and the sense of response through the releasing action of the brake becomes excellent.

Figure 4:
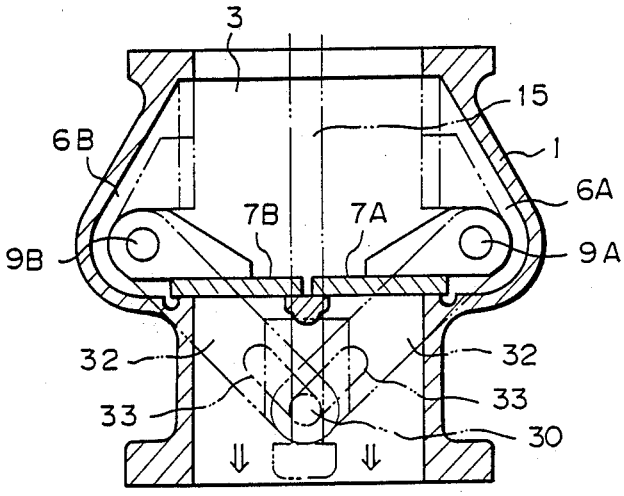
FIG. 4 is a vertical sectional view illustrating a linking mechanism of a second embodiment.

FIG. 4 shows a modified linking mechanism of another embodiment of the invention. According to this construction, the linking mechanism is made in symmetrical fashion such that a pair of flaps 7A and 7B simultaneously move to open and close the valve. Near the lowermost end of the rod 15 a pin 30 is fixed to protrude therefrom, extending through a pair of slots 33 which are formed at the respective ends of a pair of swing levers 32 of the same size. Thus, the pin 30 slides along the interior surfaces of the slots 33 during the swinging movement of the levers 32. The other ends of the levers 32 are fixed on the outwardly projecting ends of the shafts 9A and 9B, respectively. In this construction, the stroke of the actuator becomes larger than that of FIG. 3. However, there are advantages in that a slow and steady control can be effected and the number of the parts is reduced.

Figure 5:
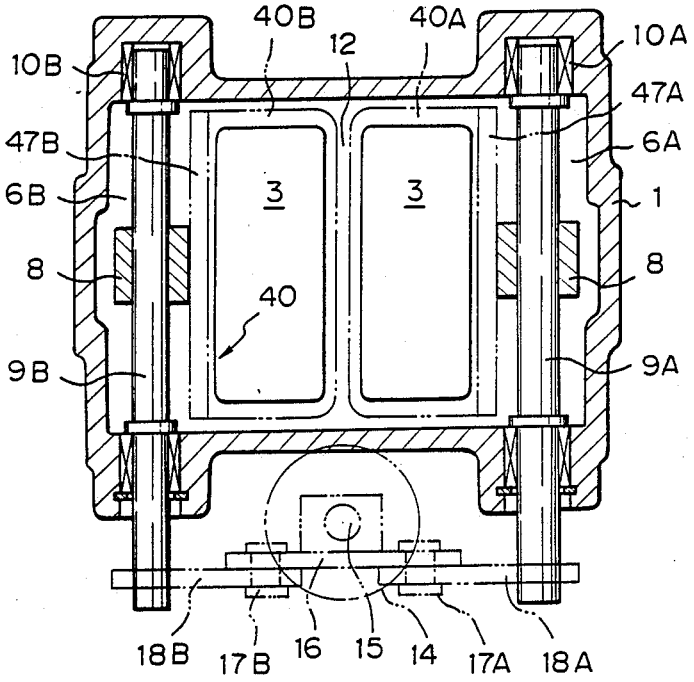
FIG. 5 is a horizontal sectional view illustrating a rectangular exhaust passage of a third embodiment.

FIG. 5 shows another modified embodiment of the invention, in which the horizontal section of the exhaust passage 3 inside the case 1 is formed to be substantially rectangular. Corresponding to the section, swing flaps 47A and 47B are rectangular and the valve seat 40 and its valve seat portions 40A and 40B are also rectangular. If this rectangular section is utilized, as compared with a circular section, a length of the diagonal of a square should be increased by 25 percent so as to obtain the same sectional area. However, on the other hand, the length from the edge to the base of a flap is reduced by 11 percent. Accordingly, the moment of force to rotate the valve member is reduced and its driving torque is considerably lowered. As a result, a working stroke of the actuator is small and the size of the actuator can be made more compact.

Figure 6:
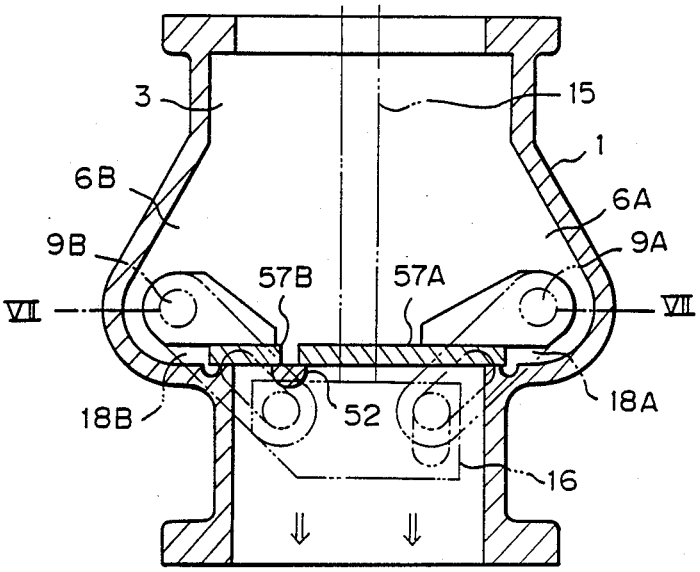
FIG. 6 is a vertical sectional view illustrating a pair of large and small valve members of a fourth embodiment.
Figure 7:
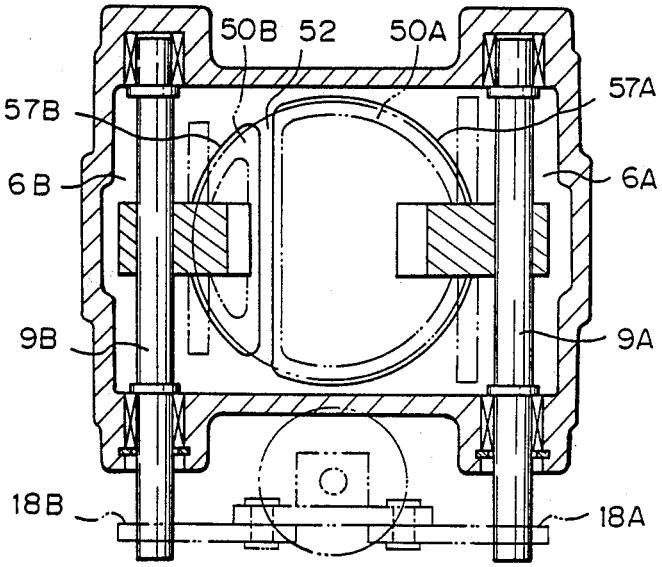
FIG. 7 is a horizontal sectional view taken along the line VII—VII of FIG. 6.

FIGS. 6 and 7 show a further modified embodiment of the invention, in which a pair of facing flaps consist of a first valve member 57A having a large covering area and a second valve member 47B having a small covering area. The first valve member 57A rests on a first valve seat portion 50A which surrounds a large area, and the second valve member 57B rests on a second valve seat portion 50B which surrounds a small area, cooperating with each other to shut off the valve. A transverse rib 52 traversing across the exhaust passage 3 may be removed as mentioned above. The linking mechanism to swing the valve members 57A and 57B is the same as shown in FIG. 3.

The modified embodiment shown in FIGS. 6 and 7 is operated as follows. When the actuator is energized to open the valve, the rod 15 moves upward and makes the valve members 57A and 57B move from the closed position as shown in straight lines of FIG. 6. At first only valve member 57B having a small area is raised to open, and after a small moment valve member 47A having a large area begins to open. As explained before, only small force is needed at the releasing moment of the brake, so that the working reaction becomes smooth and the response becomes quicker. Thus, operating performance is improved. The area ratio of the first valve member to the second valve member can be selected optionally. For example, the shut-off area covered by the second valve member is preferably defined as 5 to 40 percent of the overall area of the exhaust passage.

Therefore, as is apparent from the above description, the exhaust brake unit of the present invention can provide technical advantages as follows:

(a) Since the valve member is divided into a pair of flaps such that the flaps open and close together on hinges, the force acting upon each shaft and the bearing is reduced by half. The swinging movement of the flap becomes smooth and its durability is improved.

(b) Since a pair of flaps are moved together toward the direction or opposite the direction of the exhaust gas flow, in quite a different manner from that of a butterfly valve, the pressure and flow of the exhaust gas can be associated with the flap action. If the flaps move toward the direction of the exhaust gas flow during the closing stroke of the valve, the movement becomes quick, synchronizing the working of the actuator, and the braking action becomes speedy. In addition, since the exhaust pressure acts upon the closing flaps, sealing performance and braking torque are improved.

(c) It becomes possible to make a time lag between opening movements of the two flaps. This ensures a reduction of the initial force to open the valve against the pressure of exhaust gas flow. Since the capacity of the actuator can be reduced, the working stroke of the rod can be diminished. Thus, the exhaust brake unit can be made more compact.

(d) The pair of flaps can consist of a large area one and a small area one having a time lag between the respective opening moments. In this design, the return action becomes more smooth and operating performance becomes more quick. As a result, operating performance of the exhaust brake is prominently improved and an application range of the exhaust brake system can be considerably extended.

I claim:

1. An exhaust brake unit, comprising:

a case defining an exhaust passage therethrough, said exhaust passage having a longitudinal axis, said case including a pair of cavities opening onto said exhaust passage, the openings of said cavities being disposed in facing relation across said exhaust passage, and valve seat means in said exhaust passage disposed substantially normal to said longitudinal axis;

a first shaft rotatably mounted in one of said cavities;

a second shaft rotatably mounted in the other of said cavities;

a first swing flap fixed to said first shaft;

a second swing flap fixed to said second shaft; and means for moving said first and said second swing flaps between an open position to thereby at least substantially open said exhaust passage and a closed position in which said swing flaps abut with respective portions of said valve seat means to thereby at least substantially block said exhaust passage, said means for moving including means for producing a time lag between the movement of said first swing flap from said closed to said open position and the movement of said second swing flap from said closed to said open position.

2. A unit as in claim 1, wherein the cross-sectional area of said exhaust passage blocked by said first swing flap when in said closed position is less than the cross-sectional area of said exhaust passage blocked by said second swing flap when in said closed position.

3. A unit as in claim 2, wherein said first swing flap blocks 5 to 15 percent of the cross-sectional area of said exhaust passage when in said closed position.

4. A unit as in claim 1, wherein said moving means is connected to said swing flaps for causing the direction of initial movement of said swing flaps when moving from said closed to said open position to be substantially opposite to the direction of exhaust gas flow through said exhaust passage.

5. A unit as in claim 1, wherein said swing flaps are at least substantially received within an associated one of said cavities when in said open position.

* * * * *